US007147345B1

(12) United States Patent
Toney, Jr.

(10) Patent No.: US 7,147,345 B1
(45) Date of Patent: Dec. 12, 2006

(54) THEMES FOR FLASHLIGHT INSERTS

(76) Inventor: Samuel Toney, Jr., 166 N. Lakewood Dr., Florence, SC (US) 29501

( * ) Notice: Subject to any disclaimer, the term of this patent is extended or adjusted under 35 U.S.C. 154(b) by 13 days.

(21) Appl. No.: 10/889,583

(22) Filed: Jul. 12, 2004

(51) Int. Cl.
*F21L 4/00* (2006.01)
*F21V 3/00* (2006.01)

(52) U.S. Cl. ..... 362/208; 362/311; 362/351; 362/812; 40/555; 40/560

(58) Field of Classification Search ..... 362/186, 362/202, 208, 311, 351, 359, 812; 40/555, 40/560
See application file for complete search history.

(56) References Cited

U.S. PATENT DOCUMENTS

| | | | | |
|---|---|---|---|---|
| 1,460,644 | A | 7/1923 | Dollison et al. | |
| 2,163,329 | A * | 6/1939 | Sipior | 362/489 |
| 2,623,313 | A | 12/1952 | Fuchs | |
| 2,751,490 | A | 6/1956 | Emerson | |
| 3,014,123 | A | 12/1961 | Mainzer | |
| 3,203,126 | A * | 8/1965 | Eliot | 40/553 |
| 3,401,596 | A * | 9/1968 | Hirsch | 353/43 |
| 4,977,695 | A * | 12/1990 | Armbruster | 40/541 |
| 5,027,258 | A | 6/1991 | Schoniger et al. | |
| 5,247,491 | A | 9/1993 | Kwiatkowski | |
| 5,625,968 | A | 5/1997 | Ashall | |
| 5,633,538 | A * | 5/1997 | Nickerson | 307/10.8 |
| 5,939,979 | A | 8/1999 | Lee | |
| 6,009,650 | A * | 1/2000 | Lamparter | 40/572 |
| 6,190,026 | B1 * | 2/2001 | Moore | 362/487 |
| 6,220,737 | B1 * | 4/2001 | Baragona | 362/540 |
| 6,224,244 | B1 * | 5/2001 | Burys | 362/489 |
| 6,558,022 | B1 * | 5/2003 | Kawahara | 362/257 |
| 6,590,714 | B1 | 7/2003 | Sugawara | |
| 6,729,055 | B1 * | 5/2004 | Chou | 40/546 |
| 6,846,098 | B1 * | 1/2005 | Bourdelais et al. | 362/330 |
| 2002/0181234 | A1 * | 12/2002 | Kawahara | 362/257 |
| 2003/0099104 | A1 * | 5/2003 | Hou | 362/202 |
| 2005/0024862 | A1 * | 2/2005 | Laux | 362/186 |

FOREIGN PATENT DOCUMENTS

| | | |
|---|---|---|
| DE | 4005480 | 8/1990 |
| WO | WO98/06974 | 2/1998 |

* cited by examiner

*Primary Examiner*—Alan Cariaso
*Assistant Examiner*—Adam C. Rehm
(74) *Attorney, Agent, or Firm*—Michael I. Kroll

(57) ABSTRACT

The present invention 10 discloses an embossed lens 20 having properties that when combined and inserted into a flashlight 22 in replacement of the existing flashlights lens, augments the passing light from the flashlight into a projection 12 having a predefined shape, orientation and color themes for the typical application of presenting to viewers a symbol or logo for organizations typically in the genre of fraternities, sororities, political parties and other symbolically representable groups. The surface of the lens 20 comprises primarily a clear or tinted region 16 used as a primary backdrop during projection and composing the majority of the lenses mass while an embossed portion 18 is used to create visual differences in the projected image 12 using contrasting color and shape. Additionally, the present invention 10 may be provided with indicia 28 to present to the viewer which way the lens should be inserted into the flashlight.

6 Claims, 9 Drawing Sheets

THEMES FOR FLASHLIGHT INSERTS

BACKGROUND OF THE INVENTION

1. Field of the Invention

The present invention relates generally to optics and, more specifically, to an embossed lens having properties that when combined and inserted into a flashlight in replacement to the existing flashlights lens, augments the passing light from the flashlight into a projection having predefined shape, orientation and color themes for the typical application of presenting to viewers a symbol or logo for organizations typically in the genera of fraternities, sororities, political parties and other symbolically representable groups. The surface of the lens consists primarily of a clear or tinted region used as a primary backdrop during projection and composing the majority of the lenses mass while embossed thereupon this region are differentiating embossed portions used to create visual differences in the projected image using contrasting color and shape on the clear or tinted region to produce a diverse amount of possible configurations utilizing these color and shape patterns originating from the embossment responsible for the changes of these projections when light is passed through this diverse medium and projected to a surface. Additionally, the present invention may be provided with indicia to present to the viewer which way the lens should be inserted into the flashlight to clear confusion that may arise due to the mirrored appearance of the lens when installed on to the flashlight, while functioning the light is projected through the back side that appears correct to the eye and when light is passed through produces the image is in its correct predetermined placement.

2. Description of the Prior Art

There are other optical devices designed for projection. Typical of these is U.S. Pat. No. 1,460,644 issued to Dollison, et al. on Jul. 3, 1923.

Another patent was issued to Fuchs on Dec. 30, 1952 as U.S. Pat. No. 2,623,313. Yet another U.S. Pat. No. 2,751,490 was issued to Emerson on Jun. 19, 1956 and still yet another was issued on Dec. 19, 1961 to Mainzer as U.S. Pat. No. 3,014,123.

Another patent was issued to Schoniger on Jun. 25, 1991 as U.S. Pat. No. 5,027,258. Yet another U.S. Pat. No. 5,247,491 was issued to Kwiathowski on Sep. 21, 1993. Another was issued to Ashall on May 6, 1997 as U.S. Pat. No. 5,625,968 and still yet another was issued on Aug. 17, 1999 to Lee U.S. Pat. No. 5,939,979.

Another patent was issued to Sugawara on Jul. 8, 2003 as U.S. Pat. No. 6,590,714. Yet another German patent No. DE 4,005,480 was issued to Siegfried on Sep. 30, 1990. Another was issued to TBI concepts, L. L. C. on Feb. 19, 1998 as PCT No. WO98/06974

U.S. Pat. No. 1,460,644

Inventor: J. M. Dollison, et al.

Issued: Jul. 3, 1923

In a device of the character described, a casing having an opening at one end and being adapted to support a light emitting element therein, means within the casing for projecting rays of light from the light emitting element through the opening, a color disk rotatably supported in eccentric relation to the opening in the casing and having a plurality of translucent portions of different colors arranged in an annular series between its axis of rotation and its periphery, in position to be successively interposed between the light emitting element and the opening as the color disk is rotated, a lamp stand supporting the casing in vertical position with the end having the opening therein uppermost, a lamp shade encompassing the casing, and an inverted conical reflector within the lamp shade above the casing having the opening for reflecting rays of light upon the lining of the lamp shade.

U.S. Pat. No. 2,623,313

Inventor: P. E. Fuchs

Issued: Dec. 30, 1952

An edge-illuminated sign comprising a light transmitting plastic plate having indicia carved in a face thereof, a housing closing an edge of the plate, the portion of the edge in the housing having a series of convolutions formed therein about spaced parallel axes each being substantially normal to the faces of the plate, and means in the housing for receiving and supporting a source of light in spaced relation to the convoluted edge.

U.S. Pat. No. 2,751,490

Inventor: D. E. Emerson

Issued: Jun. 19, 1956

In an electric lighting device having a lamp bulb and having an annular dished reflector shell extending forwardly of the bulb, adjustable light filter means for said lamp, comprising a dished light filter element pivotally mounted at one end on the shell forwardly of the lamp, a dished plate mounted in said shell for rotation about the axis of the shell, said plate having an axially extending slot, said shell having an arcuate slot between the inner and outer axial limits of the slot in said plate and on a side of the shell opposite said one end of said filter element, said dished plate overlying the arcuate slot in the shell and being of sufficient width to cover said arcuate slot at any position of intersection of said arcuate and axially extending slots, and an operating element extending through both said slots and secured to the other end of said filter, said filter element being laterally swingable between its ends to a position in front of said lamp bulb upon movement of said operating element to one end of the slot in said shell and to a position to one side and forward of said lamp bulb upon movement of said operating element to the other end of the slot in said shell.

U.S. Pat. No. 3.014,123

Inventor: R. Mainzer

Issued: Dec. 19, 1961

In a device of the character described, a casing having an opening at one end and being adapted to support a light emitting element therein, means within the casing for projecting rays of light from the light emitting element through the opening, a color disk rotatably supported in eccentric relation to the opening in the casing and having a plurality of translucent portions of different colors arranged in an annular series between its axis of rotation and its periphery, in position to be successively interposed between the light emitting element and the opening as the color disk is rotated, a lampstand supporting the casing in vertical position with the end having the opening therein uppermost, a lamp shade encompassing the casing, and an inverted conical reflector within the lamp shade above the casing having the opening for reflecting rays of light upon the lining of the lamp shade.

U.S. Pat. No. 5,027,258

Inventor: Karl-Heinz Schoniger

Issued: Jun. 25, 1991

An illuminated display unit such as a board with a house number thereon or an advertising billboard, has a light guide panel. At least one electrical illuminating element is arranged in the vicinity of at least one lateral limiting edge thereof. The light guide panel serves for illuminating logo symbols, which are preferably in the form of film or of vapor coated layers, on the light guide panel. At least one of the lateral limiting edges of the light guide panel is provided with a light guide batten whose thickness is in excess of the thickness of the light guide panel and at least one of the illuminating elements is mounted in the batten. The transition between the light guide batten and the light guide panel is designed so as to have a high optical conductivity or transitivity. The external surfaces of the light guide batten are provided at least partly with an inwardly reflecting layer. This makes it possible for the light of the illuminating elements, which are more especially in the form of LED's with a large diameter, to be fully introduced in substantially thinner light guide panels in order to reduce costs and weight.

U.S. Pat. No. 5,247,491

Inventor: Zdzislaw Kwiatkowski

Issued: Sep. 21, 1993

A device for projecting a rainbow-like spectral display including a housing provided with a projecting arrangement for projecting the rainbow-like spectral display onto a viewable surface. The projecting arrangement includes segments, each segment including a light emitting source for producing light rays, and a diffraction member such as a prism for effecting a spectral dispersion of the light rays for projecting same to produce the rainbow-like spectral display. Preferably, each segment also includes a convergent or convex lens disposed between the light emitting source and the diffraction member, and a reflector covering a rear portion of each light emitting source. The housing could be portable, battery operated, and in the form of a casing provided with a hinged cover. The segments have a particular design so that in one embodiment, the rainbow-like spectral display is in the form of a religious symbol, and in another embodiment, the rainbow-like spectral display is in the form of a rainbow-like spectral digital time display. In a further embodiment, the device is a clock or watch with the projecting arrangement including numerous units angularly disposed side-by-side in a circle, with each unit including three segments disposed end to end, so that energizing particular ones of the light emitting sources of selected units provides a second hand, a minute hand and an hour hand for a rainbow-like spectral time display.

U.S. Pat. No. 5,625,968

Inventor: John Ashall

Issued: May 6, 1997

An edge lit illuminated display system has a transparent medium having first and second opposing surfaces and at least one edge operable with a light source for illuminating the first and second surfaces. A matrix of dots on each of the surfaces is arranged to allow interaction of light between the surfaces. The matrix of dots on at least one of the surfaces substantially covers the entire surface for providing an even increased illumination throughout the surface, wherein when a graphic image is supported over the surface the graphic image is evenly illuminated.

U.S. Pat. No. 5,939,979

Inventor: Howard Hong-Dough Lee

Issued: Aug. 17, 1999

A light system of a vehicle is made to comprise light cover means having at least one light-illimitable area for luminously displaying a symbol corresponding to a vehicle's trademark or a manufacturer's mark when the vehicle is initiated by a driver to perform an action such as braking, parking-signaling, hazard-signaling, turn-signaling, driving, reverse-driving, or door-opening. When implemented, the present invention economically and effectively vivifies the illumination appearance of a vehicle not only in the daylight but in the dark.

U.S. Pat. No. 6,590,714

Inventor: Saburo Sugawara

Issued: Jul. 8, 2003

The present invention has as its object to provide a projection type display apparatus which suffers little from the occurrence of the distortion of the surface of a dichromic mirror in a color combining optical system, and the occurrence of the deformation of a projected image by the angular deviation of the surface of the dichromic mirror and in which the correction of the chromatic aberration of magnification of a projection lens is stably possible during mass production. So, the color combining system of the present invention is provided with at least three prisms, two dichromic mirror layers for reflecting lights differing in wavelength area from each other, the two dichromic mirror layers being formed so as not to intersect with each other with one of the three prisms which is located most adjacent to the light exit side interposed therebetween, and at least one optical element having positive or negative refractive power. The optical element receives light from at least one of a plurality of light modulating elements, and causes the light to enter one of the at least three prisms. The light exit surface of the prism located most adjacent to the light exit side serves also as a total reflection surface for reflecting the light to one of the two dichromic mirror layers.

German Patent Number DE4005480

Inventor: Frisch Siegfried

Issued: Sep. 30, 1990

The traffic light signaling system consists of a number of identical lamp units that can be mounted in a column on a post facing the traffic direction. Each of the lamps can have a glass with a display symbol e.g STOP that are visible when activated. Each lamp can have a shade and internally a reflector to improve visibility in bright, ambient lighting.

Located at the top and bottom are a pair of additional lamps that are flash units that are triggered as an additional means of ensuring attention. The units may be arranged in a number of different layouts. ADVANTAGE—Improves presentation of traffic warning information.

PCT Number WO 98/06974

Inventor: TBI Concepts L. L. C.

Issued: Feb. 19, 1998

A flashing identification light adapter system includes a flashing light adapter with an adapter housing which is intended to replace the end cap of a conventional flashlight and includes a colored lens removably attached to the adapter housing in a covering relationship with a light source, which may be a flasher circuit and lamp connected to an independent switch. The flashing light adapter can include a housing with a dedicated switch, a strobe light and a flasher circuit housed therein and a battery cell holding sleeve such that a battery cell or cells within the sleeve are used to selectively power the flashing light and/or the conventional flashlight bulb.

While these optical devices may be suitable for the purposes for which they were designed, they would not be as suitable for the purposes of the present invention, as hereinafter described.

SUMMARY OF THE PRESENT INVENTION

The present invention discloses an embossed lens having properties that when combined and inserted into a flashlight in replacement of the existing flashlights lens, augments the passing light from the flashlight into a projection having a predefined shape, orientation and color themes for the typical application of presenting to viewers a symbol or logo for organizations typically in the genre of fraternities, sororities, political parties and other symbolically representable groups. The surface of the lens comprises primarily a clear or tinted region used as a primary backdrop during projection and composing the majority of the lenses mass while an embossed portion is used to create visual differences in the projected image using contrasting color and shape. Additionally, the present invention may be provided with indicia to present to the viewer which way the lens should be inserted into the flashlight.

A primary object of the present invention is to provide a translucent flashlight lens having the ability to create diverse combinations of colors, patterns and shapes and project them upon a surface for representation of typically fraternities, sororities, political parties and other symbolically representable groups.

Another object of the present invention is to provide a translucent flashlight lens that is easily installable to most standard flashlights.

Yet another object of the present invention is to provide translucent flashlight lens having a clear or tinted region that works in cooperation with a plurality of embossed portions to present a diverse display of possible colors, patterns and shapes.

Still yet another object of the present invention is to provide translucent flashlight lens having various forms of embossment applied upon the surface of a clear or tinted lens.

Another object of the present invention is to provide translucent flashlight lens having indicia placed along the rim of both sides to indicate to the user proper installation of the embossed lens into the flashlight.

Additional objects of the present invention will appear as the description proceeds.

The present invention overcomes the shortcomings of the prior art by providing a translucent flashlight lens having means for when installed to a flashlight of projecting diverse patterns, shapes and colors upon a surface for visual representation of groups such as fraternities, sororities, political parties and other symbolically representable groups utilizing a lens having a clear or tinted region combined with a plurality of embossed portions. Additionally, the present invention has indicia lining the surface of the lens's rim for guidance to the user for correct installation procedure of the embossed lens into the flashlight.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
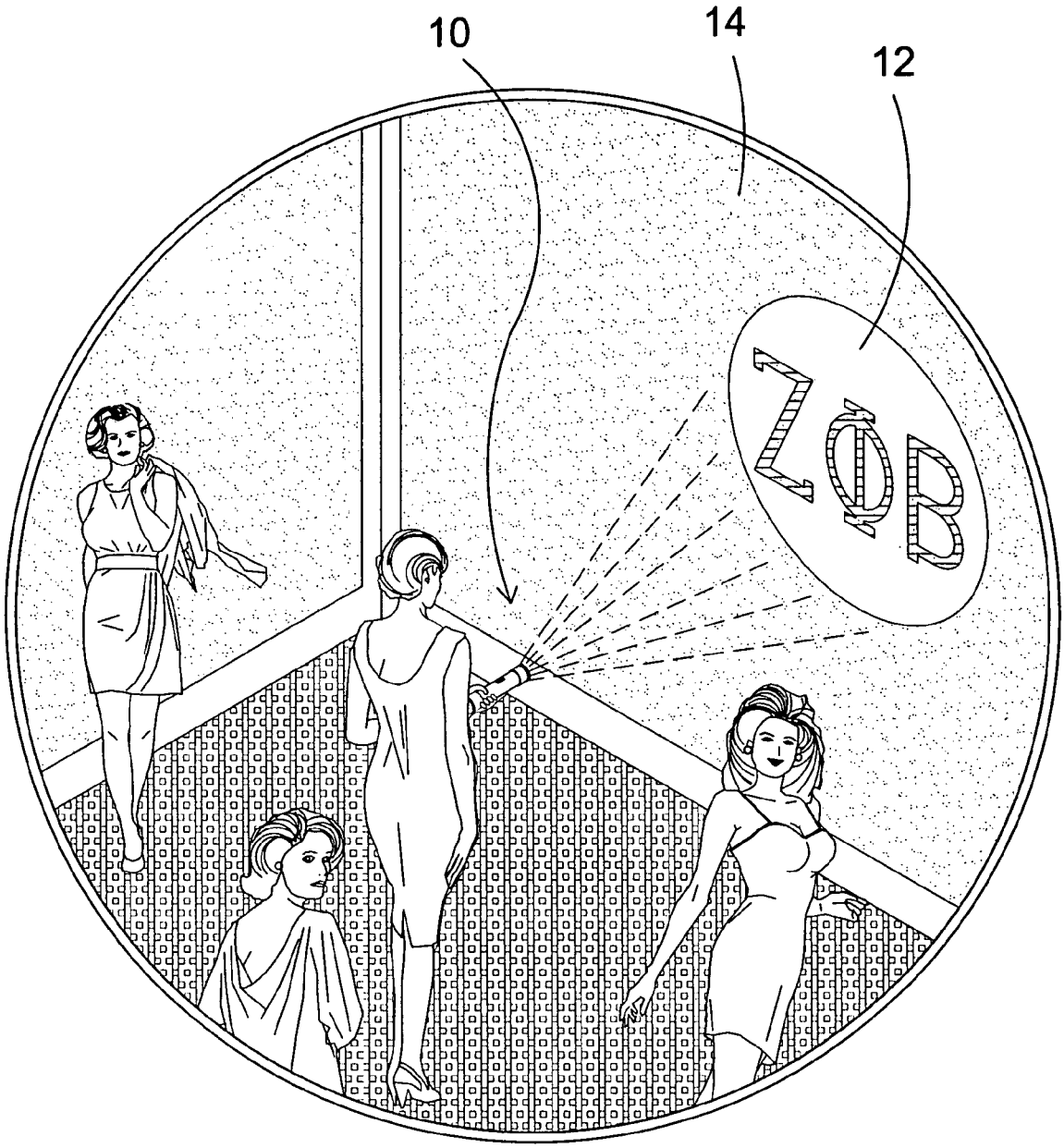
FIG. 1 is an illustrative view of the present invention in use.

With regard to reference numerals used, the following numbering is used throughout the drawings.

10 present invention
12 image
14 surface
16 clear/tinted region
18 embossed region
20 lens
22 flashlight
24 bulb
26 retainer
28 indicia
30 recess

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. Shown is the present invention 10 being an insertable transparent lens for flashlights having properties embossed thereupon its surface that augment the light that is shown through these modifications and lens resulting in the projection of various possible color combinations and shaped images 12 upon any surface 14 subjected to the projected lights path, with the nature of these images based on the configuration and orientation of the embossed regions. The uses of the present invention 10 can typically be applied to advertisement purposes and presentation to an audience of a symbol or series of markings typically but not limited to fraternities, sororities, organizations, political parties and other symbolically representable groups.

Figure 2:
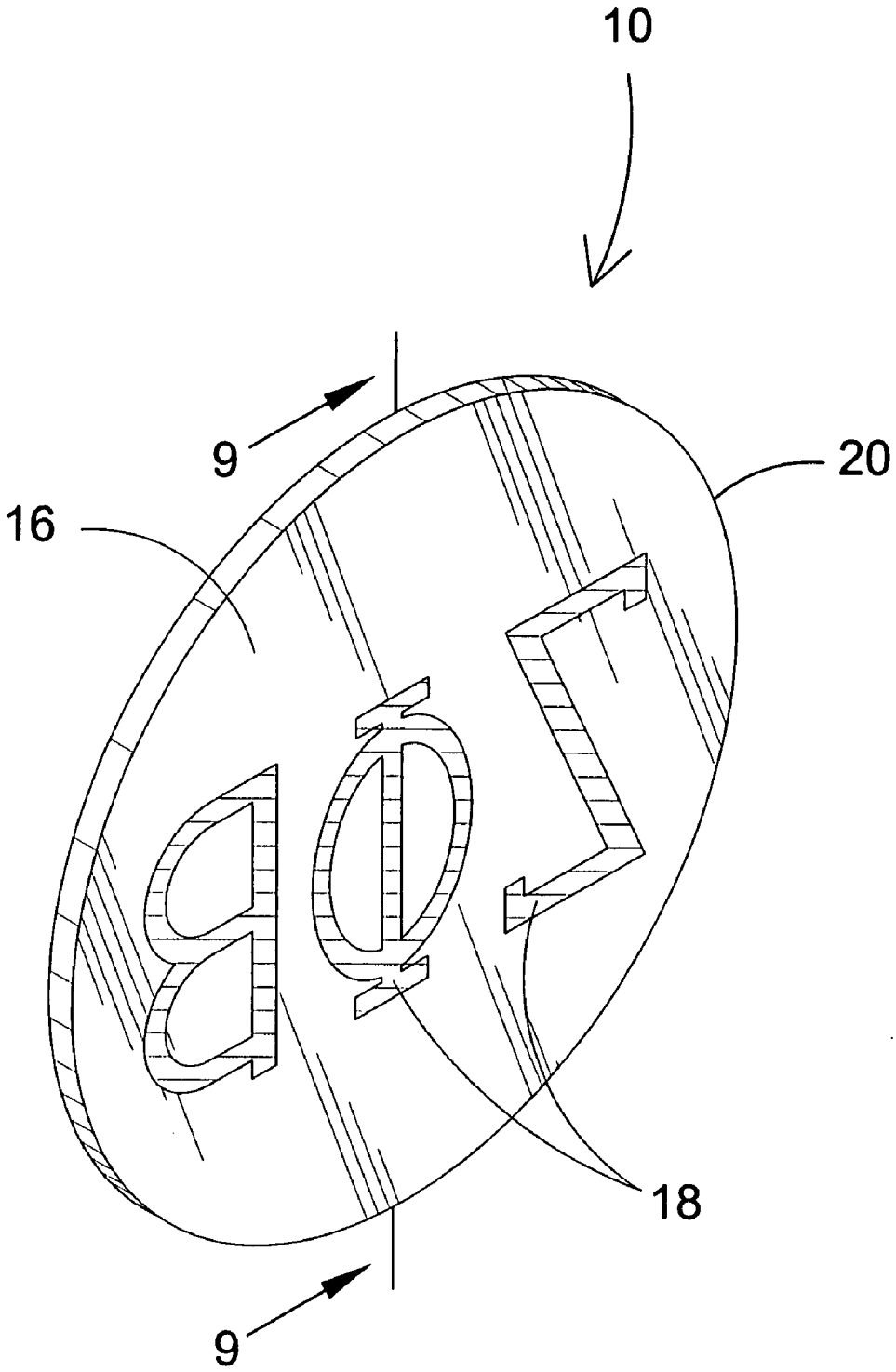
FIG. 2 is a perspective view of the present invention.

Turning to FIG. 2, shown therein is a perspective view of the present invention 10. Shown is the present invention 10 having a clear or tinted region 16 that produces a primary back drop of either pure unaffected white light or a tinted color tone that is easily distinguishable from the projected embossed regions 18 colors and light effects. The embossed areas 18 are areas upon the glass lens 20 surface whereby pigment of the user's choice is impregnated into patterns that when light is shown through will produce a desired color pigment, pattern and shape.

Figure 3:
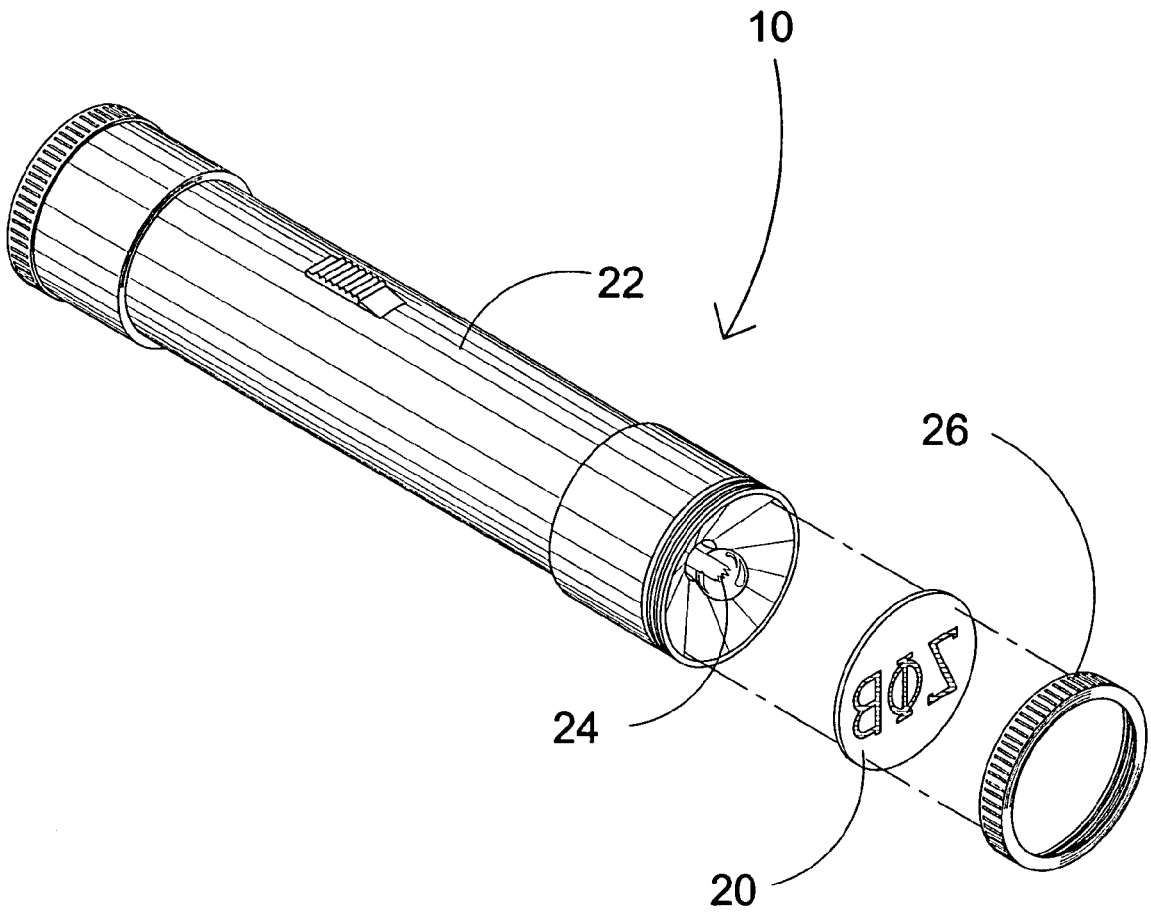
FIG. 3 is an exploded view of the present invention.

Turning to FIG. 3, shown therein is an exploded view of the present invention 10. Shown is an exploded view of the present invention 10 and the frontal portion of a typical flashlight 22 depicting the general installation and replacement process from the standard flashlight lens 20 to the embossed lens 20 of the present invention, wherein the embossed lens is placed over a flashlight's light emitting bulb 24 and then held in place by the provided retainer cap 26 or other lens securing means provided by the flashlight. Additionally, the present invention 10 enables for easy installation and can be manufactured to conform to the specs of any standard lens used for any type or make of flashlight 22.

Figure 4:
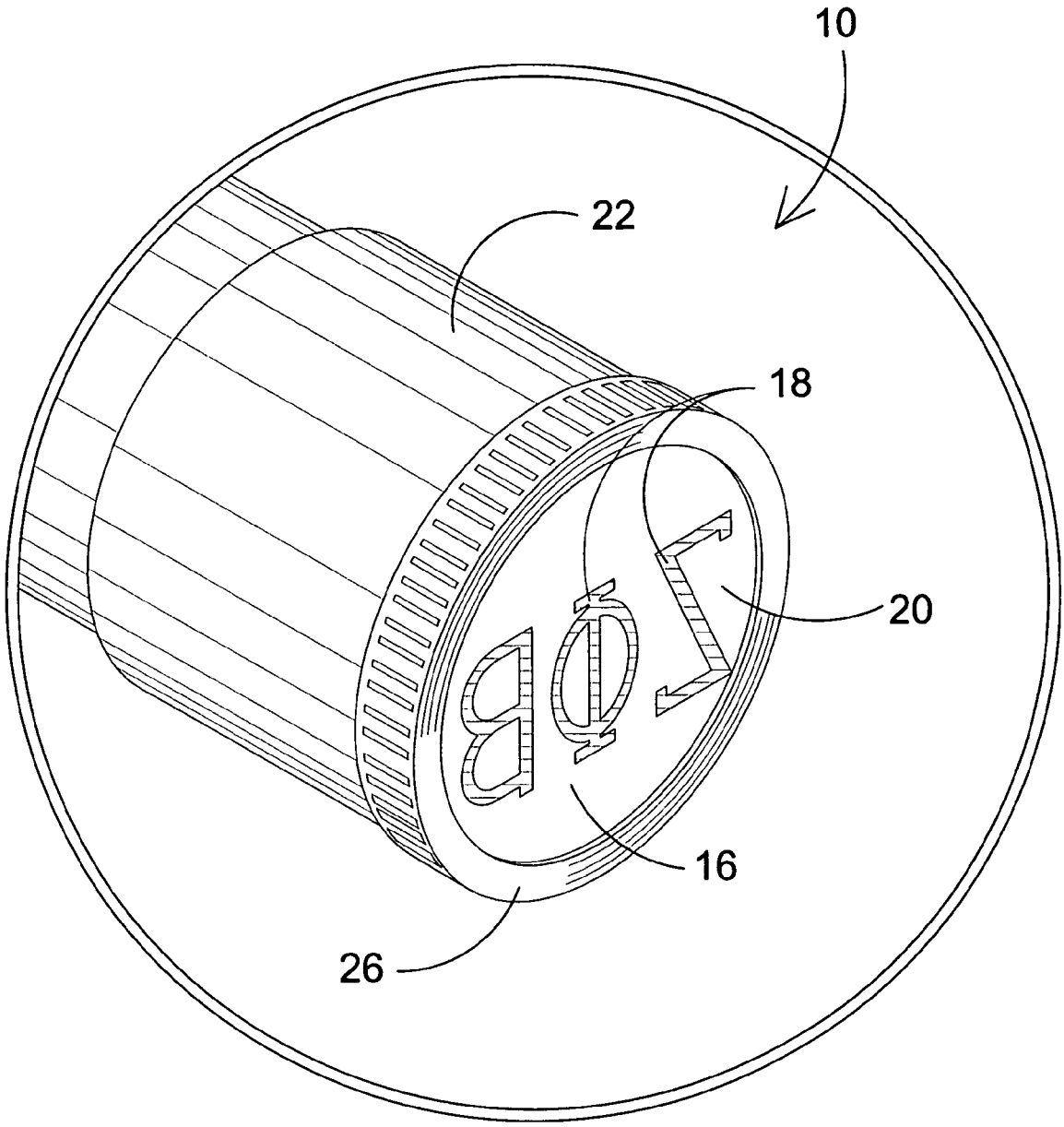
FIG. 4 is a detailed perspective view of the present invention installed on a flashlight.

Turning to FIG. 4, shown therein is a detailed perspective view of the present invention 10 installed on a flashlight 22. Shown is the present invention 10 installed into a flashlight 22 with the embossed lens 20 of the present invention serving as a replacement to the standard lens of the flashlight. Additionally shown is the embossed portion 18 of the lens 20 being primarily in a centrally disposed orientation on the lens so as to allow for the lens retainer 26 of the flashlight to hold the lens with sufficient surrounding surface perimeter area while not obstructing or covering the intended image's projection thereabout. The clear/tinted portion 16 is also shown.

Figure 5:
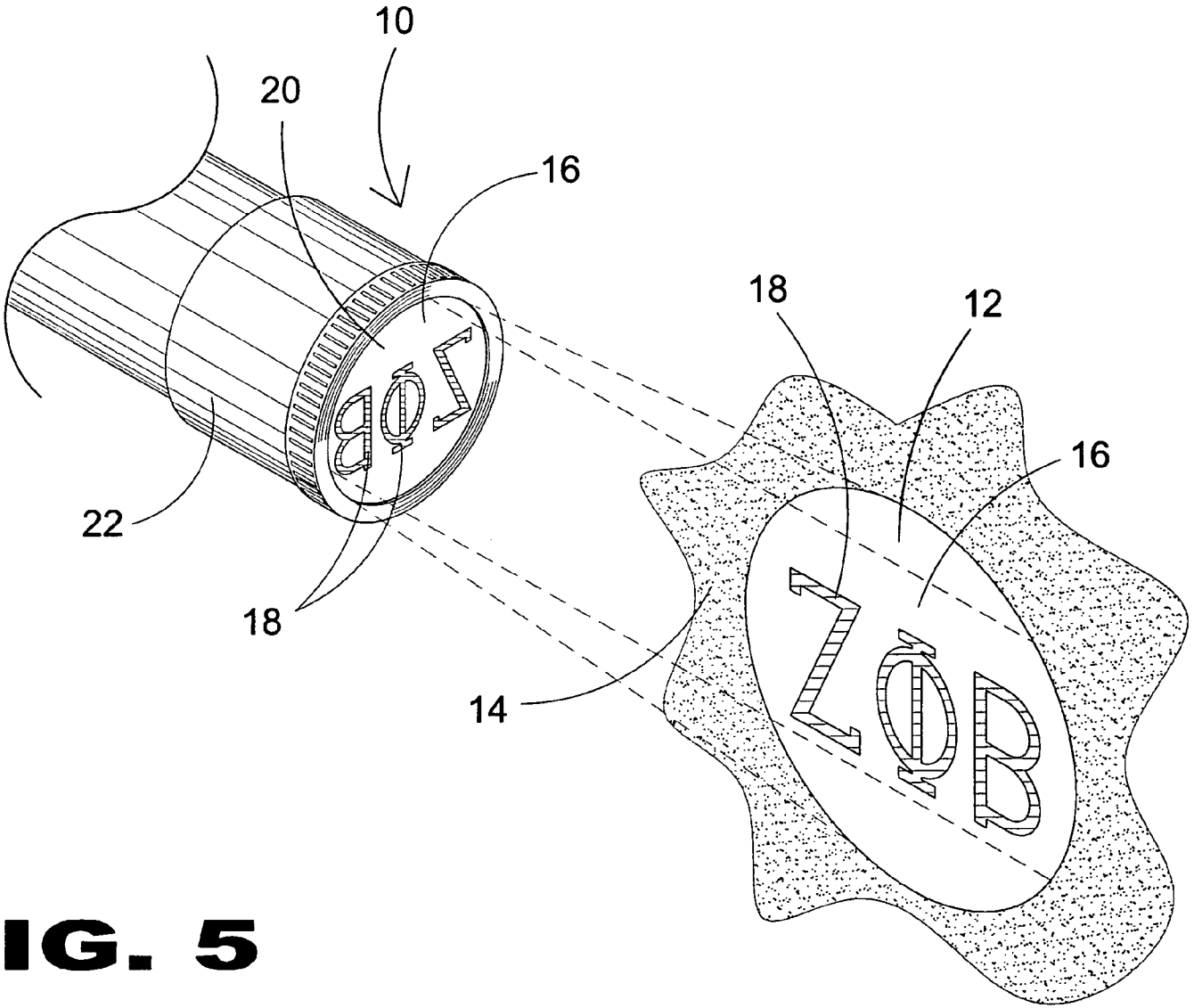
FIG. 5 is a perspective view of the present invention in use.

Turning to FIG. 5, shown therein is a perspective view of the present invention 10 in use. Shown is the present invention 10 projecting an image 12 through the embossed lens 20 of the present invention whereby the visible surface of the lens in the flashlight 22 has a mirrored relationship to the projected image from the lens on the surface 14 caused by the reverse perception of the intended image when viewing the embossed lens while installed. Additionally shown is in this mirrored relationship is the clear or tinted region 16 directly correlating to the clear or tinted projection on the surface 14 while the same is held true with the embossed portions 18 and the embossed projections on the surface.

Figure 6:
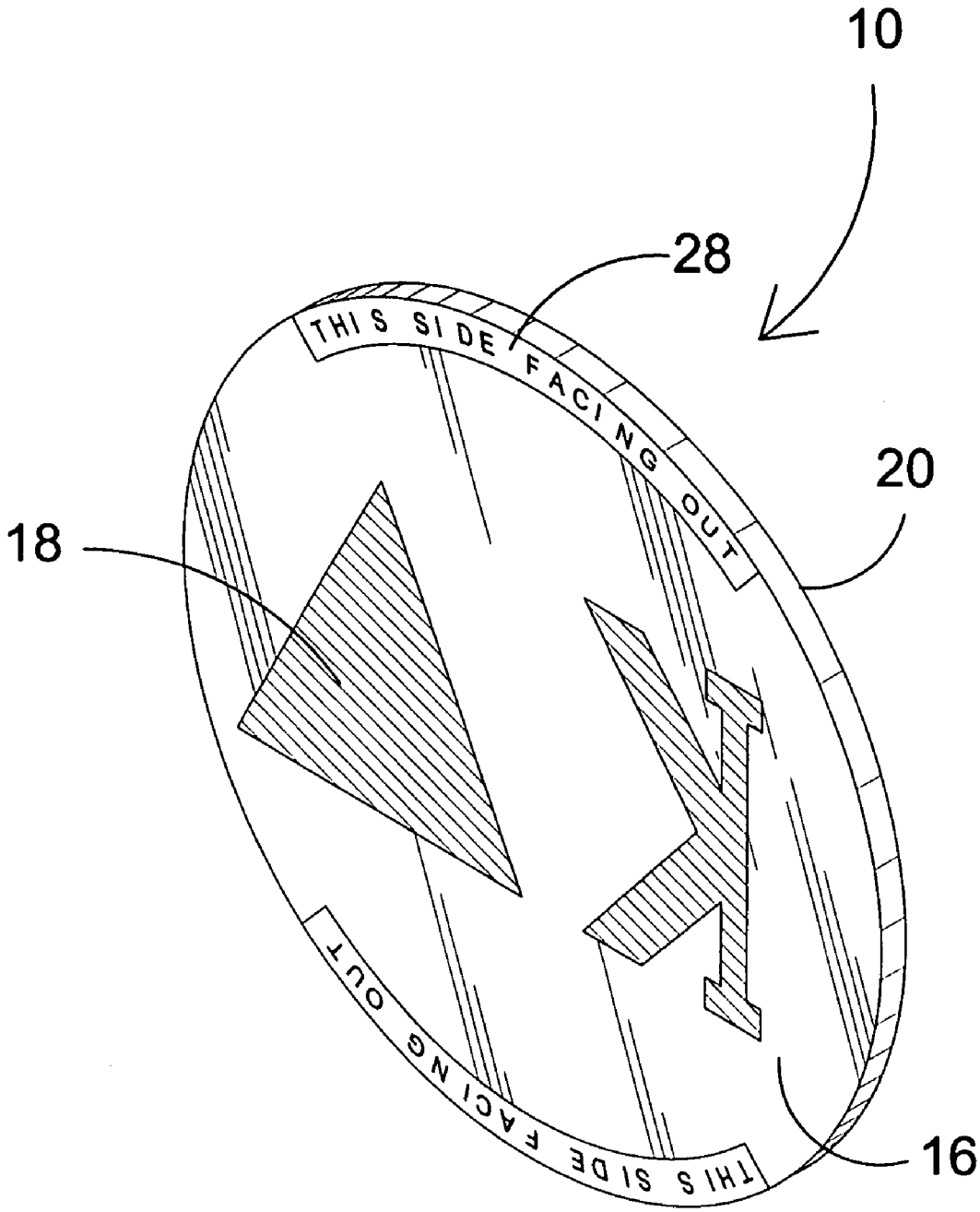
FIG. 6 is a perspective view of the present invention having an additional element.

Turning to FIG. 6, shown therein is a perspective view of the present invention 10 having an additional element. Shown is the embossed lens 20 of the present invention 10 having indicia 28 provided on the rim of the lens to indicate to the user, primarily new users, the necessity and habit of having the mirror image face outward and appear that way to the viewer when looking upon the embossed lens in such an orientation when it is installed in order to have the correct image orientation projected onto the surface subjected to the flashlights projection. The embossed portion 18 and clear/tinted portion 16 are shown.

Figure 7:
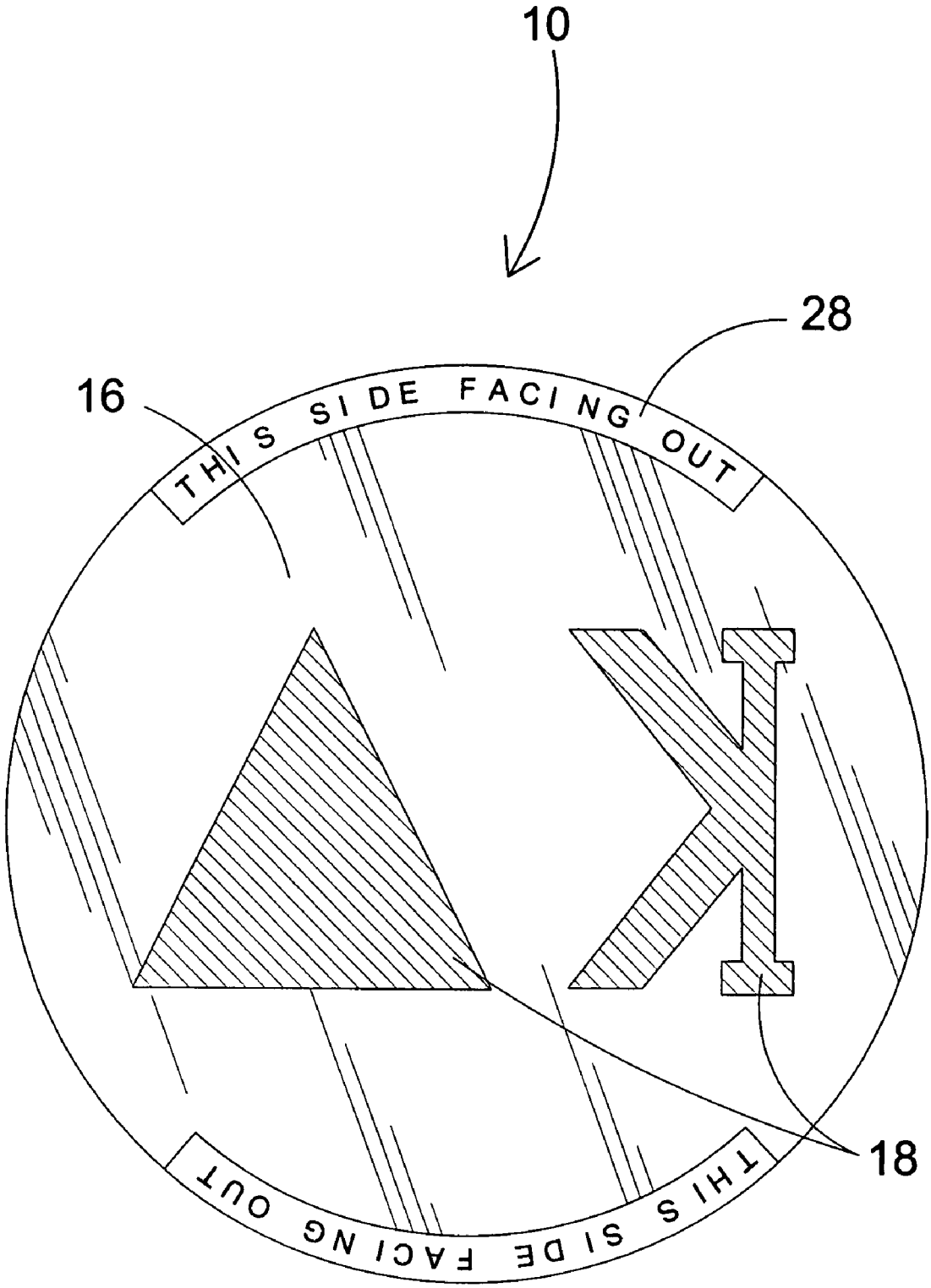
FIG. 7 is a front view of the present invention having an additional element.

Turning to FIG. 7, shown therein is a front view of the present invention 10 having an additional element. Shown is the present invention 10 as viewed from its frontal side with the image to be projected by means of the embossed portions 18 being a mirror image so as the outgoing light is projected it will be displayed in correct order and placement. Additionally shown is the present invention having indicia 28 surrounding the embossed lenses rim so as to convey to the user correct installation to a flashlight and so that the seen indicia 28 may be hidden while installed by the structure of a typical lens retainer that normally depending on its structure will cover the indicia. The clear/tinted portion 16 is also shown.

Figure 8:
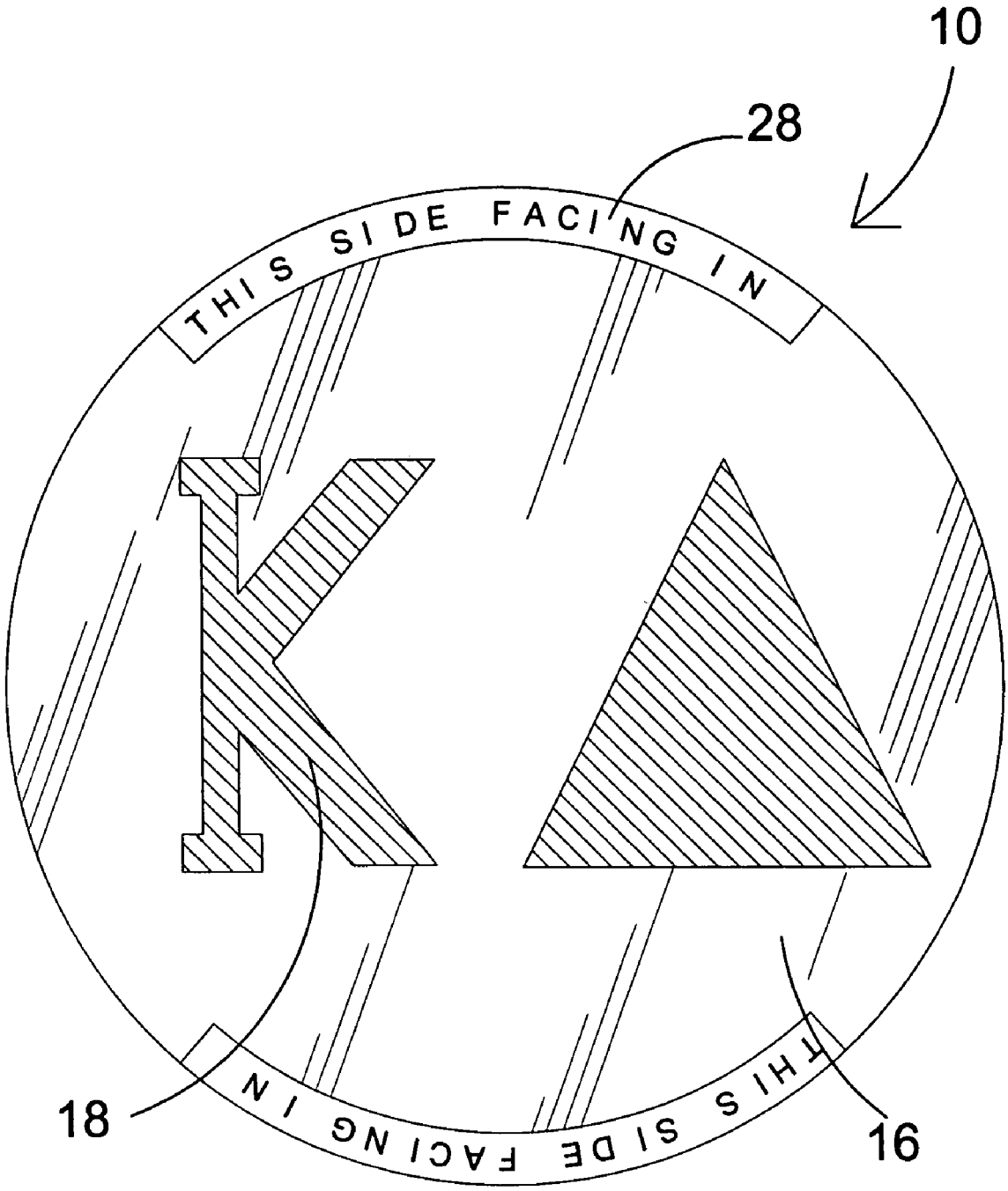
FIG. 8 is a back view of the present invention having an additional element.

Turning to FIG. 8, shown therein is a back view of the present invention 10 having an additional element. Shown is the back of the embossed lens of the present invention 10 having indicia 28 wherein the appearance of the back displays the way the projected image will appear during installation wherein the back surface faces inward and contacts the structure surrounding the light bulb while the front faces outward and contacts the surfaces of the lens retainer wherein the lens retainer is screwed into places securing the embossed lens. Additionally, indicia 28 depicting the backward side are provided for the user's guidance. Other previously disclosed elements are also shown.

Figure 9:
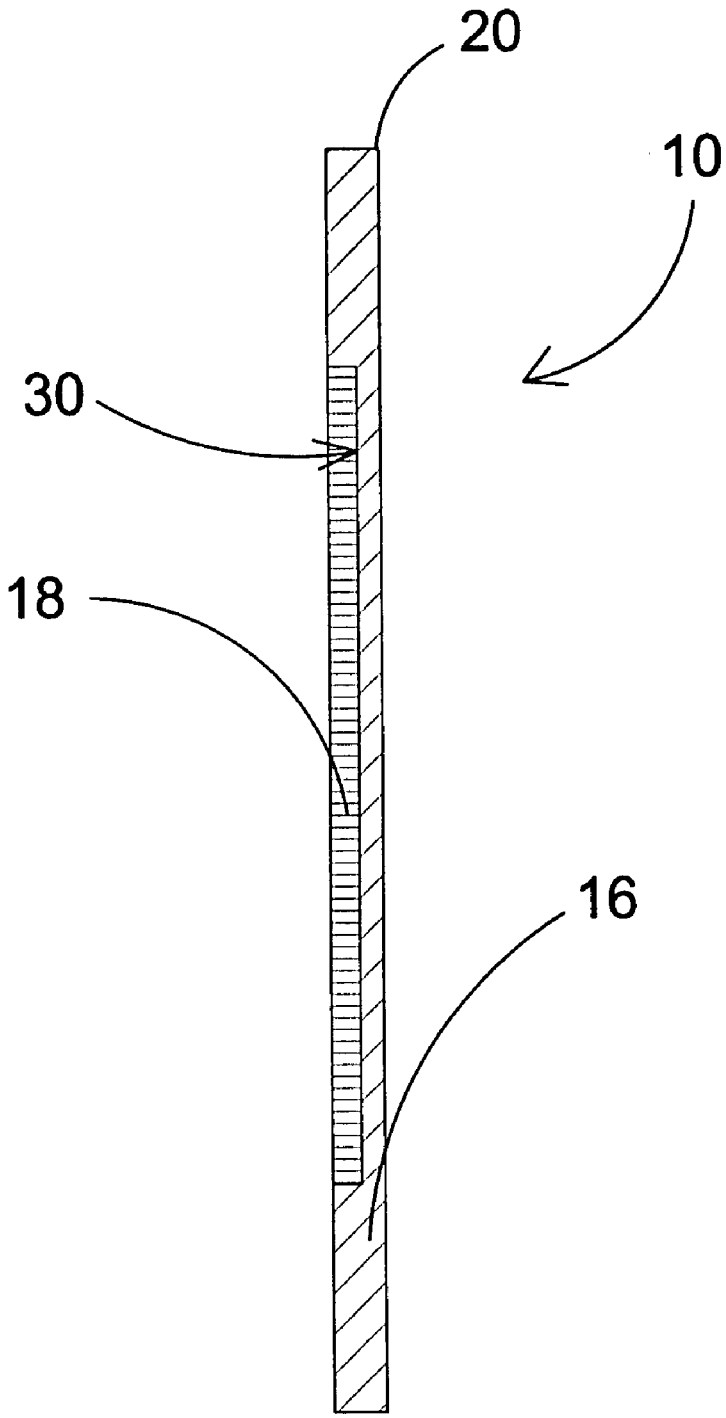
FIG. 9 is a cross section view of the present invention.

Turning to FIG. 9, shown therein is a cross section view of the present invention 10. Shown is a cross sectional view of the present invention 10 depicting the manner in which the embossing 18 is imbued upon the surface of the lens 20 wherein a cavity or recess 30 is created on the surface and a pigmented substrate is then filled and smoothed into the recess creating an assortment of possible shapes, orientations and color arrangements. The clear/tinted portion 16 is also shown.

I claim:

1. A lens for a flashlight, the flashlight having a lens retainer cap thereon, comprising:

a) said lens disposed in the flashlight, said lens having first and second opposing sides and a rim, with a light bulb inside said flashlight and said lens located between said light bulb and a retainer against said rim for retaining said lens on said flashlight;

b) an embossment disposed on said first side of said lens, said embossment comprising a recess formed in a surface of said lens, said recess being filled with a pigmented substrate having an outer surface smoothed within said recess;

c) wherein said embossment comprises a symbol being representative of a group of people, wherein said symbol is projected on a surface when the flashlight is turned on and pointed toward the surface, all light coming from said light bulb;

d) indicia on said first side of said lens adjacent said rim indicating which side of said lens to orient toward the inside of the flashlight, said retainer cap covering said indicia when said lens is mounted in said flashlight; and e) said lens having a clear portion outside of said recess, said clear portion being tinted in a contrasting color to said embossment.

2. The lens of claim 1, wherein said indicia is also disposed on said second side of said lens.

3. The lens of claim 2, wherein said symbol is centrally disposed in said lens.

4. The lens of claim 3, wherein said symbol represents a fraternity group.

5. The lens of claim 3, wherein said symbol represents a sorority group.

6. The lens of claim 3, wherein said symbol represents a political group.

* * * * *